US006552685B2

(12) United States Patent
Zhang

(10) Patent No.: US 6,552,685 B2
(45) Date of Patent: Apr. 22, 2003

(54) FLAT ANTENNA APPARATUS

(75) Inventor: Xin Zhang, Ibaraki (JP)

(73) Assignee: Hitachi Cable Ltd., Tokyo (JP)

( * ) Notice: Subject to any disclaimer, the term of this patent is extended or adjusted under 35 U.S.C. 154(b) by 0 days.

(21) Appl. No.: 09/925,845

(22) Filed: Aug. 7, 2001

(65) Prior Publication Data

US 2002/0080072 A1 Jun. 27, 2002

(30) Foreign Application Priority Data

Aug. 7, 2000 (JP) ..... 2000-244040

(51) Int. Cl.[7] ..... H01Q 1/38

(52) U.S. Cl. ..... 343/700 MS; 343/770; 343/848

(58) Field of Search ..... 343/700 MS, 767, 343/770, 795, 797, 829, 846, 848, 893

(56) References Cited

U.S. PATENT DOCUMENTS 4,816,835 A * 3/1989 Abiko et al. ..... 343/700 MS
4,926,189 A * 5/1990 Zaghloul et al. ..... 343/700 MS
4,929,959 A * 5/1990 Sorbello et al. ..... 343/700 MS
5,231,406 A * 7/1993 Sreenivas ..... 343/700 MS
5,453,751 A * 9/1995 Tsukamoto et al. .. 343/700 MS
5,534,877 A * 7/1996 Sorbello et al. ..... 343/700 MS
5,745,080 A * 4/1998 Jun ..... 343/700 MS
6,023,243 A * 2/2000 Frank ..... 343/700 MS
6,288,677 B1 * 9/2001 Fink ..... 343/700 MS
6,326,920 B1 * 12/2001 Barnett et al. ..... 343/700 MS

* cited by examiner

*Primary Examiner*—Don Wong
*Assistant Examiner*—Shih-Chao Chen
(74) *Attorney, Agent, or Firm*—Antonelli, Terry, Stout & Kraus, LLP

(57) ABSTRACT

To provide a flat antenna apparatus which improves the compatibility between the flat antenna apparatus and an electric circuit, and facilitates lamination to improve the productivity. Radiation elements (4) are constituted of a conductive plate provided on the front face of a first dielectric substrate (2), and an back ground plate (1) is constituted of a conductive plate provided on the rear face of the first dielectric substrate (2). A second dielectric substrate is provided forward of the first dielectric substrate (2), and an unnecessary radiation of shield conductive plate (11) is constituted of a conductive plate provided on the front face of this second dielectric substrate (5). These first and second dielectric substrates (2,5) are overlapped on each other.

16 Claims, 4 Drawing Sheets

FLAT ANTENNA APPARATUS

BACKGROUND OF THE INVENTION

1. Field of the Invention

The present invention relates to a flat antenna apparatus formed by laminating a plurality of plate bodies and elements, and more specifically, relates to a flat antenna apparatus in which the compatibility between the flat antenna apparatus and an electric circuit is improved, and lamination is facilitated to thereby improve productivity.

2. Prior Art

In the flat antenna apparatus which can attain high gain in the extremely high frequency band and the quasi-extremely high frequency band, heretofore, radiation elements, feeder lines, slots and non-feeding elements are formed on the FPC (Flexible Printed Circuit Board), respectively, layers consisting of these FPCs are laminated and a foaming agent is put between these layers, to thereby arrange each layer discretely.

With the flat antenna apparatus which obtains desired properties by laminating a plurality of plate bodies and elements, it is difficult to mount electrical components on the flat antenna apparatus in order to integrate this flat antenna apparatus and the electric circuit. This is expressed as compatibility between the flat antenna apparatus and the electric circuit is poor.

Moreover, the flat antenna apparatus has a problem in that the productivity thereof is poor, since accurate positioning of a plurality of plate bodies and elements is necessary for lamination.

SUMMARY OF THE INVENTION

It is therefore an object of the present invention to provide a flat antenna apparatus which solves the above problems, improves the compatibility between the flat antenna apparatus and the electric circuit, and facilitates lamination to improve the productivity.

In order to achieve the above object, a first aspect of the present invention is a flat antenna apparatus wherein a radiation element consisting of a conductor arranged forward of a dielectric plate, an unnecessary radiation of shield conductive plate having a slot corresponding to the radiation element arranged forward of the radiation element, and an back ground plate arranged at the rearward of the dielectric plate, wherein the dielectric plate is constituted of a first dielectric substrate, the radiation element being constituted of a conductive plate arranged on the front face of the first dielectric substrate, the back ground plate being constituted of a conductive plate arranged on the rear face of the first dielectric substrate, and a second dielectric substrate is provided forward of the first dielectric substrate, the unnecessary radiation of shield conductive plate being constituted of a conductive plate provided on the front face of the second dielectric substrate, and these first and second dielectric substrate are overlapped on each other. This characteristic corresponds to claim 1, and will be described as a first embodiment with reference to FIG. 1.

Also, in the above flat antenna apparatus, the dielectric plate is constituted of a first dielectric substrate, a second dielectric substrate is provided forward of the first dielectric substrate, the unnecessary radiation of shield conductive plate being constituted of a conductive plate provided on the front face of the second dielectric substrate, and the radiation element being constituted of a conductive plate provided on the rear face of the second dielectric substrate, the back ground plate being constituted of a conductive plate arranged on the rear face of the first dielectric substrate, and these first and second dielectric substrates are overlapped on each other. This characteristic corresponds to claim 2, and will be described as a modified embodiment of the first embodiment with reference to FIG. 1.

A second aspect of the present invention is a flat antenna apparatus wherein a radiation element consisting of a conductor arranged forward of a dielectric plate, an unnecessary radiation of shield conductive plate having a slot corresponding to the radiation element arranged forward of the radiation element, a non-feeding element arranged forward of the unnecessary radiation of shield conductive plate and an back ground plate arranged at the rearward of the dielectric plate, wherein the dielectric plate is constituted of a first dielectric substrate, the radiation element being constituted of a conductive plate arranged on the front face of the first dielectric substrate and the back ground plate being constituted of a conductive plate provided on the rear face of the first dielectric substrate, a second dielectric substrate is provided forward of the first dielectric substrate, the unnecessary radiation of shield conductive plate being constituted of a conductive plate provided on the front face of the second dielectric substrate, and a third dielectric substrate is provided forward of the second dielectric substrate, the non-feeding element being constituted of a conductive plate provided on the front face of this third dielectric substrate, and these first, second and third dielectric substrates are overlapped on each other. This characteristic corresponds to claim 3, and will be described as a second embodiment with reference to FIG. 2.

Also, in the above flat antenna apparatus, the dielectric plate is constituted of a first dielectric substrate, the back ground plate being constituted of a conductive plate arranged on the rear face of the first dielectric substrate, a second dielectric substrate is provided forward of the first dielectric substrate, the radiation element being constituted of a conductive plate provided on the rear face of the second dielectric substrate, and a third dielectric substrate is provided forward of the second dielectric substrate, the unnecessary radiation of shield conductive plate being constituted of a conductive plate provided on the rear face of this third dielectric substrate, and the non-feeding element being constituted of a conductive plate provided on the front face of the third dielectric substrate, and these first, second and third dielectric substrates are overlapped on each other. This characteristic corresponds to claim 4, and will be described as a first modified embodiment of the second embodiment with reference to FIG. 2.

Also, in the above flat antenna apparatus, the dielectric plate is constituted of a first dielectric substrate, the radiation element being constituted of a conductive plate provided on the front face of this first dielectric substrate and the back ground plate being constituted of a conductive plate arranged on the rear face of the first dielectric substrate, a second dielectric substrate is provided forward of the first dielectric substrate, and a third dielectric substrate is provided forward of the second dielectric substrate, the unnecessary radiation of shield conductive plate being constituted of a conductive plate provided on the rear face of this third dielectric substrate, and the non-feeding element being constituted of a conductive plate provided on the front face of the third dielectric substrate, and these first, second and third dielectric substrates are overlapped on each other. This characteristic corresponds to claim 5, and will be described as a second modified embodiment of the second embodiment with reference to FIG. 2.

A third aspect of the present invention is a flat antenna apparatus wherein a radiation element consisting of a conductor arranged forward of a dielectric plate, a non-feeding element formed corresponding to the radiation element arranged forward of the radiation element, an unnecessary radiation of shield conductive plate having a slot corresponding to the radiation element arranged forward of the non-feeding element, and an back ground plate arranged at the rearward of the dielectric plate, wherein the dielectric plate is constituted of a first dielectric substrate, the radiation element being constituted of a conductive plate provided on the front face of this first dielectric substrate and the back ground plate being constituted of a conductive plate arranged on the rear face of the first dielectric substrate, a second dielectric substrate is provided forward of the first dielectric substrate, the non-feeding element being constituted of a conductive plate provided on the front face of this second dielectric substrate, and a third dielectric substrate is provided forward of the second dielectric substrate, the unnecessary radiation of shield conductive plate being constituted of a conductive plate provided on the front face of this third dielectric substrate, and these first, second and third dielectric substrates are overlapped on each other. This characteristic corresponds to claim 6, and will be described as a third embodiment with reference to FIG. 3.

Also in the above flat antenna apparatus, the dielectric plate is constituted of a first dielectric substrate, the back ground plate being constituted of a conductive plate arranged on the rear face of the first dielectric substrate, a second dielectric substrate is provided forward of the first dielectric substrate, the radiation element being constituted of a conductive plate provided on the rear face of this second dielectric substrate, and a third dielectric substrate is provided forward of the second dielectric substrate, the non-feeding element being constituted of a conductive plate provided on the rear face of this third dielectric substrate and the unnecessary radiation of shield conductive plate being constituted of a conductive plate provided on the front face of this third dielectric substrate, and these first, second and third dielectric substrates are overlapped on each other. This characteristic corresponds to claim 7, and will be described as a first modified embodiment of the third embodiment with reference to FIG. 3.

Also in the above flat antenna apparatus, the dielectric plate is constituted of a first dielectric substrate, the radiation element being constituted of a conductive plate provided on the front face of this first dielectric substrate, and the back ground plate is constituted of a conductive plate arranged on the rear face of the first dielectric substrate, a second dielectric substrate is provided forward of the first dielectric substrate, and a third dielectric substrate is provided forward of the second dielectric substrate, the non-feeding element being constituted of a conductive plate provided on the rear face of this third dielectric substrate and the unnecessary radiation of shield conductive plate being constituted of a conductive plate provided on the front face of this third dielectric substrate, and these first, second and third dielectric substrates are overlapped on each other. This characteristic corresponds to claim 8, and will be described as a second modified embodiment of the third embodiment with reference to FIG. 3.

A fourth aspect of the present invention is a flat antenna apparatus wherein a radiation element consisting of a conductor is arranged forward of a dielectric plate, an unnecessary radiation of shield conductive plate having a slot corresponding to the radiation element and a non-feeding element formed in the slot is arranged forward of the radiation element, and an back ground plate is arranged at the rearward of the dielectric plate. This characteristic corresponds to claim 9, and will be described as a fourth embodiment with reference to FIG. 4.

The construction may be such that the dielectric plate is constituted of a first dielectric substrate, the radiation element being constituted of a conductive plate arranged on the front face of the first dielectric substrate, and the back ground plate being constituted of a conductive plate arranged on the rear face of the first dielectric substrate, and a second dielectric substrate is provided forward of the first dielectric substrate, the unnecessary radiation of shield conductive plate being constituted of a conductive plate provided on the front face of the second dielectric substrate, and these first and second dielectric substrate are overlapped on each other. This characteristic corresponds to claim 10, and will be described as a first modified embodiment of the fourth embodiment with reference to FIG. 4.

The construction may be such that a the dielectric plate is constituted of a second dielectric substrate, a first dielectric substrate is provided forward of this second dielectric substrate, the unnecessary radiation of shield conductive plate being constituted of a conductive plate provided on the front face of this first dielectric substrate and the radiation element being constituted of a conductive plate provided on the rear face of this first dielectric substrate, the back ground plate being constituted of a conductive plate provided on the rear face of the second dielectric substrate, and these first and second dielectric substrate are overlapped on each other. This characteristic corresponds to claim 11, and will be described as a second modified embodiment of the fourth embodiment with reference to FIG. 4.

The present invention exerts excellent effects as described below.

(1) Compatibility between the flat antenna apparatus and the electric circuit can be improved.

(2) Lamination is facilitated to thereby improve the productivity.

(3) According to the first embodiment, slots are provided corresponding to the radiation element. Therefore, the feeder line is intercepted, thereby influences of the feeder line with respect to the performance of the flat antenna apparatus is reduced, and the directivity of the flat antenna apparatus can be also improved.

(4) According to the second and third embodiments, since the non-feeding elements or the non-feeding elements are provided corresponding to the radiation elements, the frequency characteristics of the flat antenna apparatus can be expanded to thereby broaden the band.

(5) According to the fourth embodiment, in addition to the effects of (3) and (4), the number of dielectric plates and groundplanes is reduced by providing the non-feeding element in the slot, thereby reduce the cost of the flat antenna apparatus.

PREFERRED EMBODIMENTS OF THE INVENTION

One embodiment of the present invention will now be described with reference to the accompanying drawings.

Figure 1:
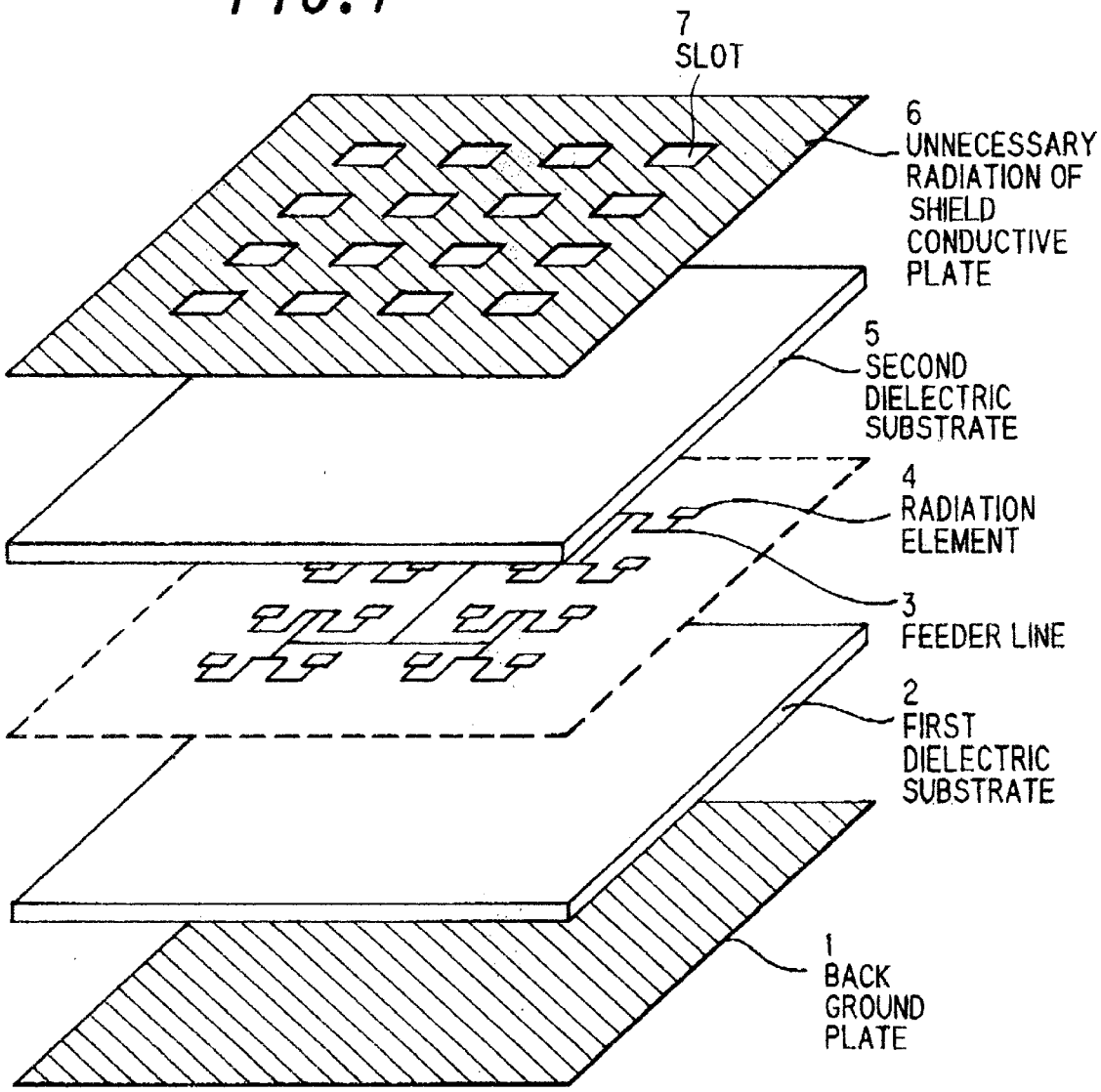
FIG. 1 is an exploded perspective view of a flat antenna apparatus according to a first embodiment of the present invention.

FIG. 1 is an exploded perspective view of a flat antenna apparatus according to a first embodiment of the present invention. This flat antenna apparatus has a construction that an back ground plate 1, a first dielectric substrate 2, radiation elements 4 comprising a plurality of conductors connected in parallel by a feeder line 3, a second dielectric substrate 5, and an unnecessary radiation of shield conductive plate 6 are overlapped one after another.

Of these, the back ground plate 1, the first dielectric substrate 2 and the radiation elements 4 are constituted of a first substrate having a printed circuit provided on the both sides thereof. That is to say, the first substrate is a double-sided printed circuit board obtained by forming the back ground plate 1 and the radiation elements 4 on the both sides of the first dielectric substrate 2 by a printed circuit. Also, the second dielectric substrate 5 and the unnecessary radiation of shield conductive plate 6 are constituted of a second substrate having a printed circuit provided on one side. That is to say, the second substrate is a single-sided printed circuit board obtained by forming the unnecessary radiation of shield conductive plate 6 on one side of the second dielectric substrate 5 by a printed circuit.

The first dielectric substrate 2 comprises a resin known by the product name "Teflon". A copper foil is formed on the both faces of this first dielectric substrate 2, the copper foil on one face is made to be the back ground plate 1, and by etching the copper foil on the opposite face, a plurality of radiation elements 4 connected in parallel by the feeder line 3 is formed to thereby form the first substrate. The second dielectric substrate 5 comprises a resin similar to that of the first dielectric substrate 2. By forming a copper foil on one face of this second dielectric substrate 5 and etching this copper foil, slots are formed to form the unnecessary radiation of shield conductive plate 6, thereby the second substrate is formed.

A bonding sheet (not shown) is put between the first substrate and the second substrate and is melt by heating, thereby the first substrate and the second substrate are bonded and integrated.

According to such a flat antenna apparatus, the first substrate and the second substrate can be realized by a printed circuit board by means of etching processing, respectively. The first substrate and the second substrate can be also integrated by bonding. As a result, the productivity of the flat antenna apparatus can be improved.

The flat antenna apparatus according to the first embodiment can be changed and constructed as described below. That is to say, the back ground plate 1 and the first dielectric substrate 2 are constituted of a first substrate having a printed circuit provided on one side. Moreover, the radiation elements 4, the second dielectric substrate 5 and the unnecessary radiation of shield conductive plate 6 are constituted of a second substrate having a printed circuit provided on the both side. A bonding sheet is put between the first substrate and the second substrate and is melt by heating, thereby the first substrate and the second substrate are bonded and integrated.

Also in this modified embodiment, the first substrate and the second substrate can be realized by a printed circuit board by means of etching processing, respectively. The first substrate and the second substrate can be also integrated by bonding. As a result, the productivity of the flat antenna apparatus can be improved.

Figure 2:
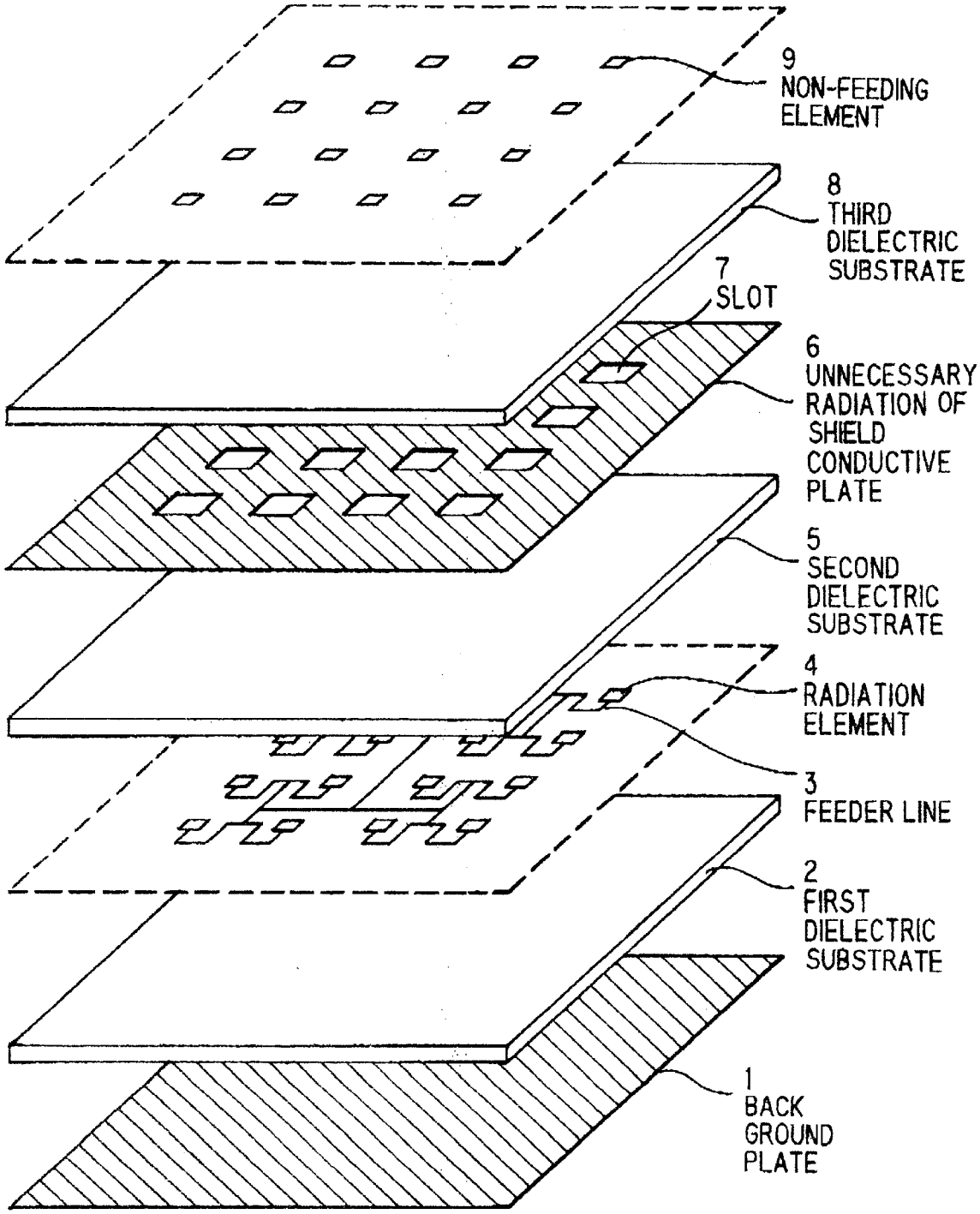
FIG. 2 is an exploded perspective view of a flat antenna apparatus according to a second embodiment of the present invention.

FIG. 2 is an exploded perspective view of a flat antenna apparatus according to a second embodiment of the present invention. This flat antenna apparatus has a construction that an back ground plate 1, a first dielectric substrate 2, radiation elements 4 comprising a plurality of conductors connected in parallel by a feeder line 3, a second dielectric substrate 5, an unnecessary radiation of shield conductive plate 6, a third dielectric substrate 8 and non-feeding elements 9 are overlapped one after another.

The back ground plate 1, the first dielectric substrate 2 and the radiation elements 4 are constituted of a first substrate having a printed circuit provided on the both sides thereof. That is to say, the first substrate is a double-sided printed circuit board obtained by forming the back ground plate 1 and the radiation elements 4 on the both sides of the first dielectric substrate 2 by a printed circuit. Also, the second dielectric substrate 5 and the unnecessary radiation of shield conductive plate 6 are constituted of a second substrate having a printed circuit provided on one side. That is to say, the second substrate is a single-sided printed circuit board obtained by forming the unnecessary radiation of shield conductive plate 6 on one side of the second dielectric substrate 6 by a printed circuit. Moreover, the third dielectric substrate 8 and the non-feeding elements 9 are constituted of a third substrate having a printed circuit provided on one side. That is to say, the third substrate is a single-sided printed circuit board obtained by forming the non-feeding element so none side of the third dielectric substrate 8 by a printed circuit.

The first dielectric substrate 2 comprises a resin known by the product name "Teflon". A copper foil is formed on the both faces of this first dielectric substrate 2, the copper foil on one face is made to be the back ground plate 1, and by etching the copper foil on the opposite face, a plurality of radiation elements 4 connected in parallel by the feeder line 3 is formed to thereby form the first substrate. The second dielectric substrate 5 comprises a resin similar to that of the first dielectric substrate 2. By forming a copper foil on one face of this second dielectric substrate 5 and etching this copper foil, slots are formed to form the unnecessary radiation of shield conductive plate 6, thereby the second substrate is formed. The third dielectric substrate 8 comprises a resin similar to that of the first dielectric substrate 2. By forming a copper foil on one face of this third dielectric substrate 8 and etching this copper foil, the non-feeding elements 9 are formed to thereby form the third substrate.

A bonding sheet (not shown) is put between the first substrate and the second substrate, and between the second substrate and the third substrate, respectively, and is melt by heating, thereby each substrate is bonded and integrated.

According to such a flat antenna apparatus, the first substrate and the second substrate and the third substrate can be realized by a printed circuit board by means of etching processing, respectively. The first substrate, the second substrate and the third substrate can be also integrated by bonding. As a result, the productivity of the flat antenna apparatus can be improved.

The flat antenna apparatus according to the second embodiment can be changed and constructed as described below.

In the flat antenna apparatus, being a first modified embodiment of the second embodiment, the back ground plate 1 and the first dielectric substrate 2 are constituted of a first substrate having a printed circuit provided on one side. Moreover, the radiation elements 4 and the second dielectric substrate 5 are constituted of a second substrate having a printed circuit provided on one side. Moreover, the unnecessary radiation of shield conductive plate 6, the third dielectric substrate 8 and the non-feeding elements 9 are constituted of a third substrate having a printed circuit provided on the both sides. A bonding sheet (not shown) is put between the first substrate and the second substrate and between the second substrate and the third substrate, respectively, and is melt by heating, thereby each substrate is bonded and integrated.

Also in this modified embodiment, the first substrate, the second substrate and the third substrate can be realized by a printed circuit board by means of etching processing, respectively. The first substrate, the second substrate and the third substrate can be also integrated by bonding. As a result, the productivity of the flat antenna apparatus can be improved.

In the flat antenna apparatus, being a second modified embodiment of the second embodiment, the back ground plate 1, the first dielectric substrate 2 and the radiation elements 4 are constituted of a first substrate having a printed circuit provided on the both sides. Moreover, the second dielectric substrate 5 is constituted of a second substrate without having a printed circuit on the both sides. Moreover, the unnecessary radiation of shield conductive plate 6, the third dielectric substrate 8 and the non-feeding elements 9 are constituted of a third substrate having a printed circuit provided on the both sides. A bonding sheet (not shown) is put between the first substrate and the second substrate and between the second substrate and the third substrate, respectively, and is melt by heating, thereby each substrate is bonded and integrated.

According to such a flat antenna apparatus, the first substrate and the third substrate can be realized by a printed circuit board by means of etching processing, respectively. The first substrate, the second substrate and the third substrate can be also integrated by bonding. As a result, the productivity of the flat antenna apparatus can be improved.

Figure 3:
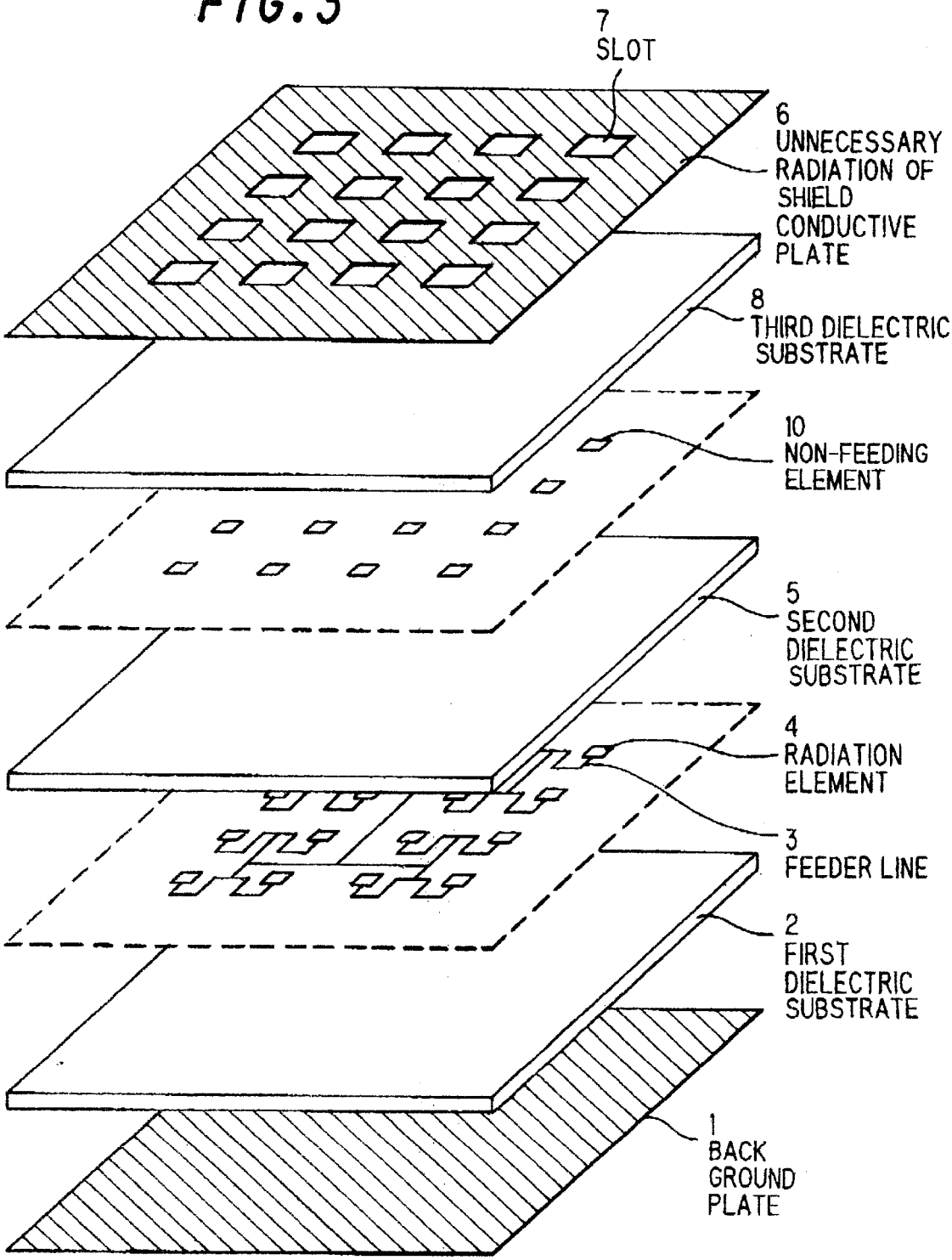
FIG. 3 is an exploded perspective view of a flat antenna apparatus according to a third embodiment of the present invention.

FIG. 3 is an exploded perspective view of a flat antenna apparatus according to a third embodiment of the present invention. This flat antenna apparatus has a construction that an back ground plate 1, a first dielectric substrate 2, radiation elements 4 comprising a plurality of conductors connected in parallel by a feeder line 3, a second dielectric substrate 5, non-feeding elements 10, a third dielectric substrate 8 and an unnecessary radiation of shield conductive plate 6 are overlapped one after another.

The back ground plate 1, the first dielectric substrate 2 and the radiation elements 4 are constituted of a first substrate having a printed circuit provided on the both sides thereof. That is to say, the first substrate is a double-sided printed circuit board obtained by forming the back ground plate 1 and the radiation elements 4 on the both sides of the first dielectric substrate 2 by a printed circuit. Also, the second dielectric substrate 5 and the non-feeding elements 10 are constituted of a second substrate having a printed circuit provided on one side. That is to say, the second substrate is a single-sided printed circuit board obtained by forming the non-feeding elements 10 on one side of the second dielectric substrate 5 by a printed circuit. Moreover, the third dielectric substrate 8 and the unnecessary radiation of shield conductive plate 6 are constituted of a third substrate having a printed circuit provided on one side. That is to say, the third substrate is a single-sided printed circuit board obtained by forming the unnecessary radiation of shield conductive plate 6 on one side of the third dielectric substrate 8 by a printed circuit.

The first dielectric substrate 2 comprises a resin known by the product name "Teflon". A copper foil is formed on the both faces of this first dielectric substrate 2, the copper foil on one face is made to be the back ground plate 1, and by etching the copper foil on the opposite face, a plurality of radiation elements 4 connected in parallel by the feeder line 3 are formed to thereby form the first substrate. The second dielectric substrate 5 comprises a resin similar to that of the first dielectric substrate 2. By forming a copper foil on one face of this second dielectric substrate 5 and etching this copper foil, the non-feeding elements 10 are formed to form the second substrate. The third dielectric substrate 8 comprises a resin similar to that of the first dielectric substrate 2. By forming a copper foil on one face of this third dielectric substrate 8 and etching this copper foil, the unnecessary radiation of shield conductive plate 6 is formed to thereby form the third substrate.

A bonding sheet (not shown) is put between the first substrate and the second substrate, and between the second substrate and the third substrate, respectively, and is melt by heating, thereby each substrate is bonded and integrated.

According to such a flat antenna apparatus, the first substrate and the second substrate and the third substrate can be realized by a printed circuit board by means of etching processing, respectively. The first substrate, the second substrate and the third substrate can be also integrated by bonding. As a result, the productivity of the flat antenna apparatus can be improved.

The flat antenna apparatus according to the third embodiment can be changed and constructed as described below.

In the flat antenna apparatus, being a first modified embodiment of the third embodiment, the back ground plate 1 and the first dielectric substrate 2 are constituted of a first substrate having a printed circuit provided on one side. The radiation elements 4 and the second dielectric substrate 5 are constituted of a second substrate having a printed circuit provided on one side. Moreover, the non-feeding elements 10, the third dielectric substrate 8 and the unnecessary radiation of shield conductive plate 6 are constituted of a third substrate having a printed circuit provided on the both sides. A bonding sheet (not shown) is put between the first substrate and the second substrate and between the second substrate and the third substrate, respectively, and is melt by heating, thereby each substrate is bonded and integrated.

Also in this modified embodiment, the first substrate, the second substrate and the third substrate can be realized by a printed circuit board by means of etching processing, respectively. The first substrate, the second substrate and the third substrate can be also integrated by bonding. As a result, the productivity of the flat antenna apparatus can be improved.

In the flat antenna apparatus, being a second modified embodiment of the third embodiment, the back ground plate 1, the first dielectric substrate 2 and the radiation elements 4 are constituted of a first substrate having a printed circuit provided on the both sides. The second dielectric substrate 5 is constituted of a second substrate without having a printed circuit on the both sides. Moreover, the non-feeding elements 10, the third dielectric substrate 8 and the unnecessary radiation of shield conductive plate 6 are constituted of a third substrate having a printed circuit provided on the both sides. A bonding sheet (not shown) is put between the first substrate and the second substrate and between the second substrate and the third substrate, respectively, and is melt by heating, thereby each substrate is bonded and integrated.

According to such a flat antenna apparatus, the first substrate and the third substrate can be realized by a printed circuit board by means of etching processing, respectively. The first substrate, the second substrate and the third substrate can be also integrated by bonding. As a result, the productivity of the flat antenna apparatus can be improved.

Figure 4:
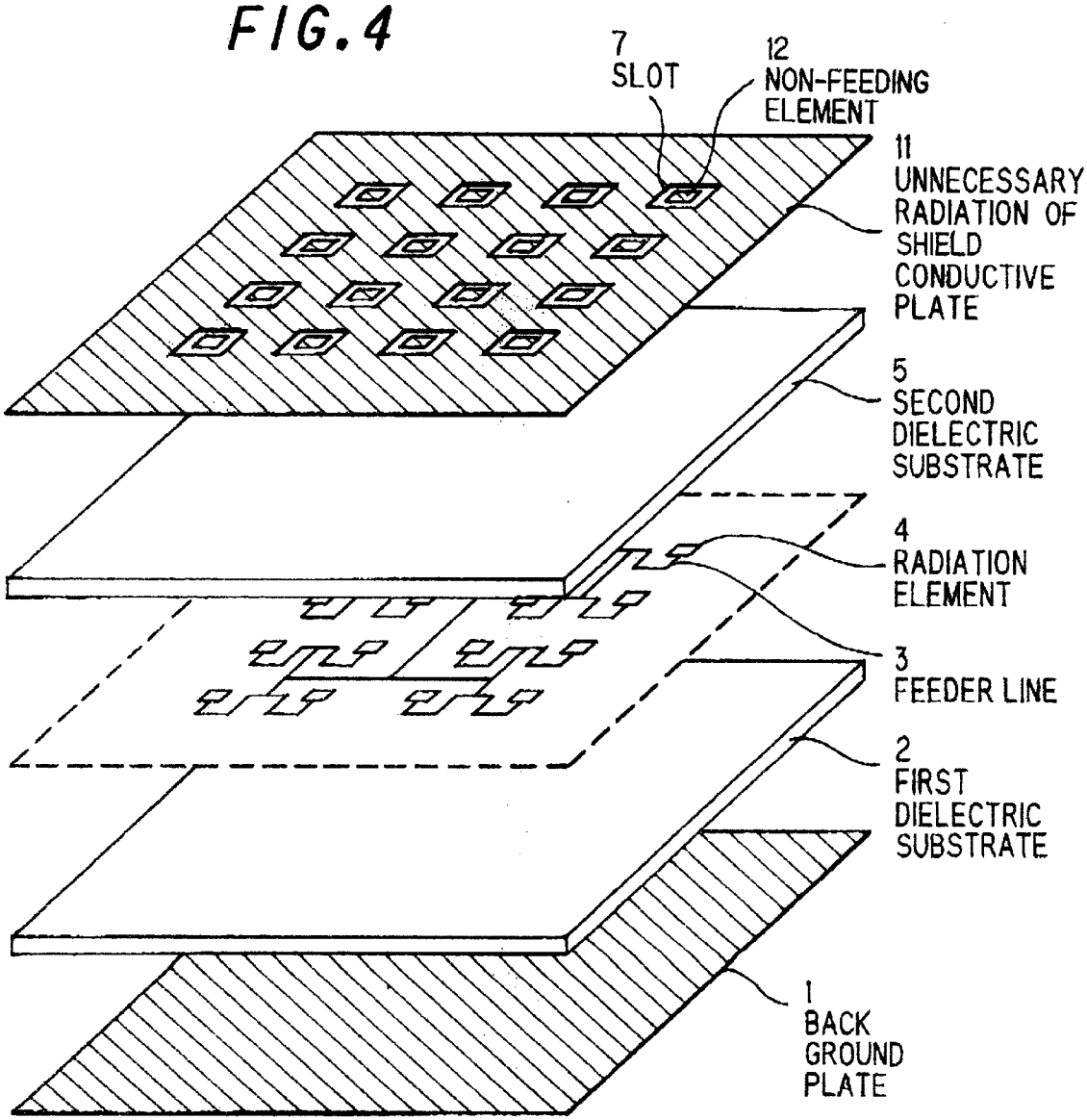
FIG. 4 is an exploded perspective view of a flat antenna apparatus according to a fourth embodiment of the present invention.

FIG. 4 is an exploded perspective view of a flat antenna apparatus according to a fourth embodiment of the present invention. This flat antenna apparatus has a construction that an back ground plate 1, a first dielectric substrate 2, radiation elements 4 comprising a plurality of conductors connected in parallel by a feeder line 3, a second dielectric substrate 5, and an unnecessary radiation of shield conductive plate 11 having slots 7 corresponding to the radiation elements 4 and non-feeding elements 12 formed in the slots 7 are overlapped one after another.

According to such a flat antenna apparatus, the unnecessary radiation of shield conductive plate 11 has non-feeding elements 12 in the slots 7, and hence the unnecessary radiation of shield conductive plate 6 and the non-feeding elements 9 can be provided together.

The flat antenna apparatus according to the fourth embodiment can be changed and constructed as described below.

In the flat antenna apparatus, being a first modified embodiment of the fourth embodiment, the back ground plate 1, the first dielectric substrate 2 and the radiation elements 4 are constituted of a first substrate having a printed circuit provided on the both sides. That is to say, the first substrate is a double-sided printed circuit board obtained by forming the back ground plate 1 and the radiation elements 4 on the both sides of the first dielectric substrate 2 by a printed circuit. Also, the second dielectric substrate 5 and the unnecessary radiation of shield conductive plate 11 are constituted of a second substrate having a printed circuit provided on one side. That is to say, the second substrate is a single-sided printed circuit board obtained by forming the unnecessary radiation of shield conductive plate 11 on one side of the second dielectric substrate 5 by a printed circuit.

The first dielectric substrate 2 comprises a resin known by the product name "Teflon". A copper foil is formed on the both faces of this first dielectric substrate 2, the copper foil on one face is made to be the back ground plate 1, and by etching the copper foil on the opposite face, a plurality of radiation elements 4 connected in parallel by the feeder line 3 are formed to thereby form the first substrate. The second dielectric substrate 5 comprises a resin similar to that of the first dielectric substrate 2. By forming a copper foil on one face of this second dielectric substrate 5 and etching this copper foil, the slots 7 and the non-feeding elements 12 in the slots 7 are formed to form the unnecessary radiation of shield conductive plate 11, thereby the second substrate is formed.

A bonding sheet (not shown) is put between the first substrate and the second substrate, and is melt by heating, thereby the first substrate and the second substrate are bonded and integrated.

According to such a flat antenna apparatus, the first substrate and the second substrate can be realized by a printed circuit board by means of etching processing, respectively. The first substrate and the second substrate can be also integrated by bonding. As a result, the productivity of the flat antenna apparatus can be improved.

In the flat antenna apparatus, being a second modified embodiment of the fourth embodiment, the back ground plate 1 and the first dielectric substrate 2 are constituted of a first substrate having a printed circuit provided on one side. Moreover, the radiation elements 4, the second dielectric substrate 5 and the unnecessary radiation of shield conductive plate 11 are constituted of a second substrate having a printed circuit provided on the both sides. A bonding sheet is put between the first substrate and the second substrate and is melt by heating, thereby the first substrate and the second substrate are bonded and integrated.

According to such a flat antenna apparatus, the first substrate and the second substrate can be realized by a printed circuit board by means of etching processing, respectively. The first substrate and the second substrate can be also integrated by bonding. As a result, the productivity of the flat antenna apparatus can be improved.

As described above, the flat antenna apparatus shown in FIG. 1 to FIG. 4 has a construction that a dielectric plate is respectively put between each layer, in order to laminate and arrange plate bodies and elements, such as the back ground plate 1, the radiation elements 4, the feeder line 3, the slots 7, the non-feeding elements 9 and 12, and the non-feeding elements 10. Moreover, each plate body and element are integrally formed by means of a printed circuit or the like, on the surface of any dielectric plate adjacent to these plate body and element, and these dielectric plates are overlapped to thereby integrate the whole apparatus. As a result, accurate positioning and lamination of plate bodies and elements become easy, to thereby improve the productivity of the flat antenna apparatus. Moreover, mounting of the electrical components on the flat antenna apparatus is facilitated, to thereby improve the compatibility between the flat antenna apparatus and the electric circuit.

What is claimed is:

1. A flat antenna apparatus having a radiation element consisting of a conductor arranged forward of a dielectric plate, an unnecessary radiation of shield conductive plate having a slot corresponding to said radiation element arranged forward of the radiation element, a non-feeding element arranged forward of the unnecessary radiation of shield conductive plate and an back ground plate arranged at the rearward of said dielectric plate, wherein said dielectric plate is constituted of a first dielectric substrate, said radiation element being constituted of a conductive plate provided on the front face of said first dielectric substrate and said back ground plate being constituted of a conductive plate provided on the rear face of said first dielectric substrate, a second dielectric substrate is provided forward of said first dielectric substrate, said unnecessary radiation of shield conductive plate being constituted of a conductive plate provided on the front face of said second dielectric substrate, and a third dielectric substrate is provided forward of said second dielectric substrate, said non-feeding element being constituted of a conductive plate provided on the front face of this third dielectric substrate, and these first, second and third dielectric substrates are overlapped on each other.

2. A flat antenna apparatus having a radiation element consisting of a conductor arranged forward of a dielectric plate, an unnecessary radiation of shield conductive plate having a slot corresponding to said radiation element arranged forward of the radiation element, a non-feeding element arranged forward of the unnecessary radiation of shield conductive plate and an back ground plate arranged at the rearward of said dielectric plate, wherein said dielectric plate is constituted of a first dielectric substrate, said back ground plate being constituted of a conductive plate provided on the rear face of said first dielectric substrate, a second dielectric substrate is provided forward of said first dielectric substrate, said radiation element being constituted of a conductive plate provided on the rear face of said second dielectric substrate, a third dielectric substrate is provided forward of said second dielectric substrate, said unnecessary radiation of shield conductive plate being constituted of a conductive plate provided on the rear face of this third dielectric substrate, and said non-feeding element being constituted of a conductive plate provided on the front face of said third dielectric substrate, and these first, second and third dielectric substrates are overlapped on each other.

3. A flat antenna apparatus having a radiation element consisting of a conductor arranged forward of a dielectric plate, an unnecessary radiation of shield conductive plate having a slot corresponding to said radiation element arranged forward of the radiation element, a non-feeding element arranged forward of the unnecessary radiation of shield conductive plate and an back ground plate arranged at the rearward of said dielectric plate, wherein said dielectric plate is constituted of a first dielectric substrate, said radiation element being constituted of a conductive plate provided on the front face of this first dielectric substrate and said back ground plate being constituted of a conductive plate arranged on the rear face of said first dielectric substrate, a second dielectric substrate is provided forward of said first dielectric substrate, and a third dielectric substrate is provided forward of said second dielectric substrate, said unnecessary radiation of shield conductive plate being constituted of a conductive plate provided on the rear face of this third dielectric substrate, and said non-feeding element being constituted of a conductive plate provided on the front face of said third dielectric substrate, and these first, second and third dielectric substrates are overlapped on each other.

4. A flat antenna apparatus having a radiation element consisting of a conductor arranged forward of a dielectric plate, a non-feeding element formed corresponding to said radiation element arranged forward of said radiation element, an unnecessary radiation of shield conductive plate having a slot corresponding to said radiation element arranged forward of the non-feeding element, and an back ground plate arranged at the rearward of said dielectric plate, wherein said dielectric plate is constituted of a first dielectric substrate, said radiation element being constituted of a conductive plate provided on the front face of this first dielectric substrate and said back ground plate being constituted of a conductive plate arranged on the rear face of said first dielectric substrate, a second dielectric substrate is provided forward of said first dielectric substrate, said non-feeding element being constituted of a conductive plate provided on the front face of this second dielectric substrate, and a third dielectric substrate is provided forward of said second dielectric substrate, said unnecessary radiation of shield conductive plate being constituted of a conductive plate provided on the front face of this third dielectric substrate, and these first, second and third dielectric substrates are overlapped on each other.

5. A flat antenna apparatus having a radiation element consisting of a conductor arranged forward of a dielectric plate, a non-feeding element formed corresponding to said radiation element arranged forward of said radiation element, an unnecessary radiation of shield conductive plate having a slot corresponding to said radiation element arranged forward of the non-feeding element, and an back ground plate arranged at the rearward of said dielectric plate, wherein said dielectric plate is constituted of a first dielectric substrate, said back ground plate being constituted of a conductive plate arranged on the rear face of said first dielectric substrate, a second dielectric substrate is provided forward of said first dielectric substrate, said radiation element being constituted of a conductive plate provided on the rear face of this second dielectric substrate, a third dielectric substrate is provided forward of said second dielectric substrate, said non-feeding element being constituted of a conductive plate provided on the rear face of this third dielectric substrate and said unnecessary radiation of shield conductive plate being constituted of a conductive plate provided on the front face of this third dielectric substrate, and these first, second and third dielectric substrates are overlapped on each other.

6. A flat antenna apparatus having a radiation element consisting of a conductor arranged forward of a dielectric plate, a non-feeding element formed corresponding to said radiation element arranged forward of said radiation element, an unnecessary radiation of shield conductive plate having a slot corresponding to said radiation element arranged forward of the non-feeding element, and an back ground plate arranged at the rearward of said dielectric plate, wherein said dielectric plate is constituted of a first dielectric substrate, said radiation element being constituted of a conductive plate provided on the front face of this first dielectric substrate, and said back ground plate is constituted of a conductive plate arranged on the rear face of said first dielectric substrate, a second dielectric substrate is provided forward of said first dielectric substrate, and a third dielectric substrate is provided forward of said second dielectric substrate, said non-feeding element being constituted of a conductive plate provided on the rear face of this third dielectric substrate and said unnecessary radiation of shield conductive plate being constituted of a conductive plate provided on the front face of this third dielectric substrate, and these first, second and third dielectric substrates are overlapped on each other.

7. A flat antenna apparatus wherein a radiation element consisting of a conductor is arranged forward of a dielectric plate, an unnecessary radiation of shield conductive plate having a slot corresponding to said radiation element and a non-feeding element formed in the slot is arranged forward of the radiation element, and an back ground plate is arranged at the rearward of said dielectric plate.

8. The flat antenna apparatus according to claim 7, wherein said dielectric plate is constituted of a first dielectric substrate, said radiation element being constituted of a conductive plate arranged on the front face of said first dielectric substrate, and said back ground plate being constituted of a conductive plate arranged on the rear face of said first dielectric substrate, and a second dielectric substrate is provided forward of said first dielectric substrate, said unnecessary radiation of shield conductive plate being constituted of a conductive plate provided on the front face of said second dielectric substrate, and these first and second dielectric substrate are overlapped on each other.

9. The flat antenna according to claim 7, wherein said dielectric plate is constituted of a second dielectric substrate, a first dielectric substrate is provided forward of this second dielectric substrate, said unnecessary radiation of shield conductive plate being constituted of a conductive plate provided on the front face of this first dielectric substrate and said radiation element being constituted of a conductive plate provided on the rear face of this first dielectric substrate, said back ground plate being constituted of a conductive plate provided on the rear face of said second dielectric substrate, and these first and second dielectric substrate are overlapped on each other.

10. A flat plate antenna, comprising:

a radiating element;

an unnecessary radiation of shield conductive plate having a slot corresponding to the radiating element; and a non-feeding element;

a first dielectric element having the radiating element formed on a front face thereof; and a second dielectric element, forward of the first dielectric element and having a front face and a rear face, with the rear face opposed to the front face of the first dielectric element, and also having the unnecessary radiation of shield conductive plate formed on the front face thereof, wherein the non-feeding element is one of (i) disposed forward of the unnecessary radiation of shield conductive plate, and (ii) disposed between the unnecessary radiation of shield conductive plate and the radiating element.

11. The flat plate antenna according to claim 10, further comprising:

a first dielectric element having the radiating element formed on a front face thereof; and a second dielectric element, forward of the first dielectric element and having a front face and a rear face, with the rear face opposed to the front face of the first dielectric element, and also having the unnecessary radiation of shield conductive plate formed on the front face thereof.

12. The flat plate antenna according to claim 11, wherein:

the non-feeding element is disposed forward of the unnecessary radiation of shield conductive plate.

13. The flat plate antenna according to claim 12, further comprising:

a third dielectric element, forward of the second dielectric element and having a front face and a rear face, with the rear face opposed to the front face of the second dielectric element;

wherein the non-feeding element is formed on the front face of the third dielectric element.

14. The flat plate antenna according to claim 11, wherein:

the non-feeding element is disposed between the unnecessary radiation of shield conductive plate and the radiating element.

15. The flat plate antenna according to claim 14, further comprising:

a third dielectric element, disposed between the first and the second dielectric elements and having a front face and a rear face, with the rear face opposed to the front face of the first dielectric element;

wherein the non-feeding element is formed on the front face of the third dielectric element.

16. The flat plate antenna according to claim 11, further comprising:

a conductive plate formed on the rear face of the first dielectric element.

* * * * *